United States Patent [19]

Dubach

[11] Patent Number: 4,573,600

[45] Date of Patent: Mar. 4, 1986

[54] SNAP CLOSURE FOR A CONTAINER

[75] Inventor: Werner F. Dubach, Maur, Switzerland

[73] Assignee: Alfatechnic AG, Dietlikon, Switzerland

[21] Appl. No.: 618,037

[22] Filed: Jun. 7, 1984

[30] Foreign Application Priority Data

Jun. 10, 1983 [CH] Switzerland ..... 3191/83

[51] Int. Cl.[4] ..... B65D 51/04

[52] U.S. Cl. ..... 215/237; 220/335; 220/339

[58] Field of Search ..... 215/244, 245, 237, 235; 220/339, 334, 335

[56] References Cited

U.S. PATENT DOCUMENTS

| | | | |
|---|---|---|---|
| 3,628,215 | 12/1971 | Everburg | 220/339 X |
| 3,629,901 | 12/1971 | Wolf et al. | 220/339 X |
| 3,933,271 | 1/1976 | McGhie | 220/339 X |
| 4,034,926 | 7/1977 | Wegner | 220/335 X |
| 4,386,714 | 6/1983 | Roberto et al. | 220/335 X |

FOREIGN PATENT DOCUMENTS

| | | | |
|---|---|---|---|
| 22600 | 3/1936 | Australia | 215/237 |
| 152346 | 1/1938 | Austria | 215/237 |
| WO82/02532 | 8/1982 | PCT Int'l Appl. | 220/339 |

*Primary Examiner*—Donald F. Norton

*Attorney, Agent, or Firm*—Lee, Smith & Zickert

[57] ABSTRACT

A synthetic material closure, which is superimposable on firm or deformable containers or is an integral component of a container, presents a lower part and a cap or cover. The cap is integrally joined over at least one tensioning band with the lower part. The tensioning bands run in a plane which cuts the synthetic material closure, i.e. cap and lower part in the closed stage of the closure. The closure can be realized with or without hinge. The arrangement of the tensioning bands in the above-described manner brings about a closing force. These can be mounted on a large number of different container, or be a component of a can.

10 Claims, 12 Drawing Figures

SNAP CLOSURE FOR A CONTAINER

The present invention relates to a synthetic material closure for firm or deformable containers, which closure is an integral component of the container or is superimposable upon this, with a lower part and a cap or cover integrally joined with the lower part over at least one tensioning band.

From Swiss patent No. 619,413 there is known a synthetic material closure of the above-mentioned type. The function of the tensioning band or of the tensioning bands of this patent are as a retainer which holds the cap when it is opened in the open position. Such provisions have long been known in closure technology in the most diverse execution. The tensioning bands according to the above-mentioned patent lie in the closed position of the closure in a plane outside the closure. Because, however, the tensioning bands are tensioned in the closed position of the closure, they have the tendency to open the same and the closure should, consequently, always be provided with corresponding locking members lying opposite the tensioning bands, which counteract this effect.

Another known solution for counteracting the undesired opening effect of the tensioning bands is presented on same patent. Here, an integral film hinge is arranged on lower part and cap in such a way that the axis of rotation lies still farther from the center of the closure, outside the same.

This solution has several disadvantages:

(a) In the opening and closing process there result considerable forces that place enormous demands on the film hinge. Consequently, such closures can be fabricated only of high-quality, expensive synthetic material, such as, for example, polypropylene.

(b) The arrangement of the film hinge relatively far outside the closure proper requires considerable adaptations to the closing machine of a filling installation. Not only must the apparatus be shaped correspondingly in form, but also the feed of the closure must be exactly positioned.

(c) The closing force of the tensioning bands, even with relatively remote arrangement of the film hinge outside the closure, is only slight.

(d) The requirement of having to have a film hinge at all leads to a compelling movement mechanism which has an extremely restrictive effect on the geometric formation of the lower part and cap. In particular, closures with added structures on the lower part, such as, for example, a raised pouring opening into which a centering pin arranged in the cap is to engage, are difficult to manufacture. In any case in the closing or opening process there occurs a considerable strain on the film hinge and the entire closure there is constantly slightly deformed. In particular the edges of the centerping pin and of the pouring lip are damaged, whereby both the sealing effect and the pouring properties of the closure suffer.

The object of the invention is to create a closure of the type described at the outset, which obviates the disadvantages enumerated.

This object is met by a closure according to the patent in that in the closed state of the closure the tensioning band or the tensioning bands run in a plane which intersects the synthetic material closure.

In this arrangement the resulting force of the tensioning bands acts as closing force of the closure also in the closed state of the same.

In a preferred embodiment of the closure the tensioning band plane can run parallel to a perpendicular to the separating plane between lower part and cap. Thus the resulting force in the closing position is introduced exactly vertical to the separating plane.

Further embodiments and their advantages are evident from the claims and the following specification. In the drawing various forms of the invention are represented and explained in the specification.

Figure 1:
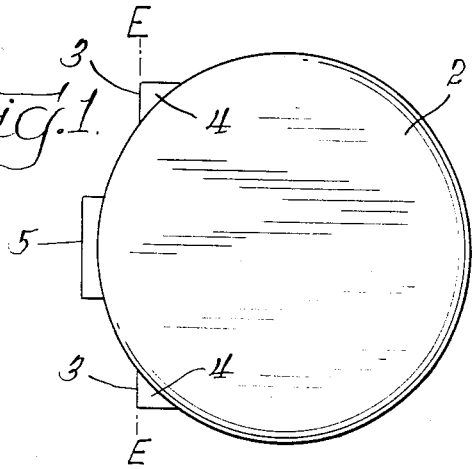
FIG. 1 shows a cylindrical closure in plan.
Figure 3:
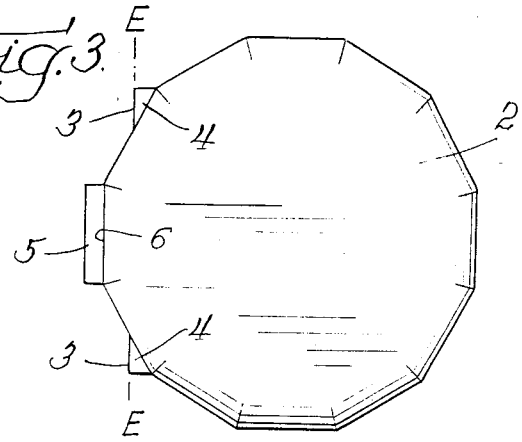
Figure 2:
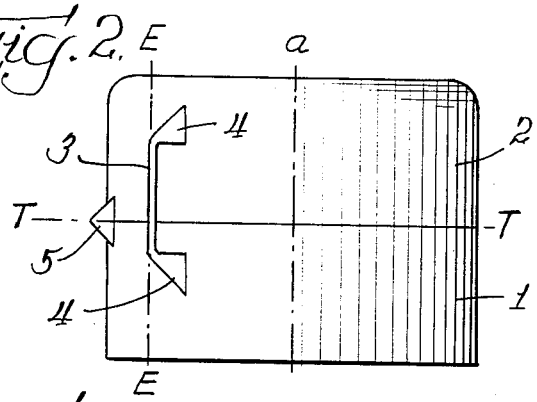
FIG. 2 shows the same closure in side view
Figure 4:
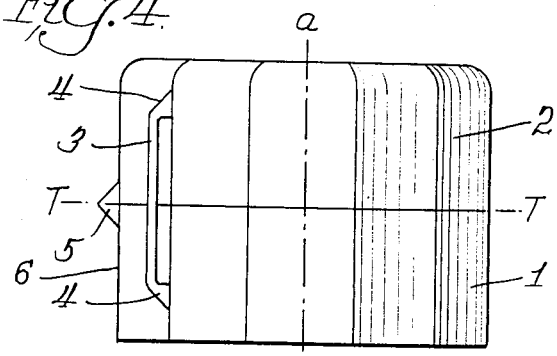
Figure 6:
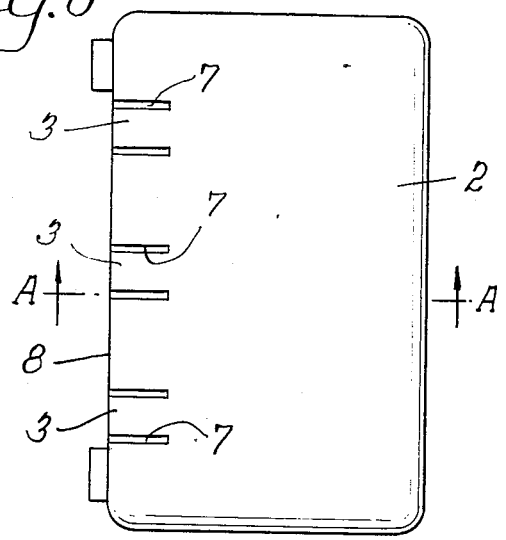
Figure 5:
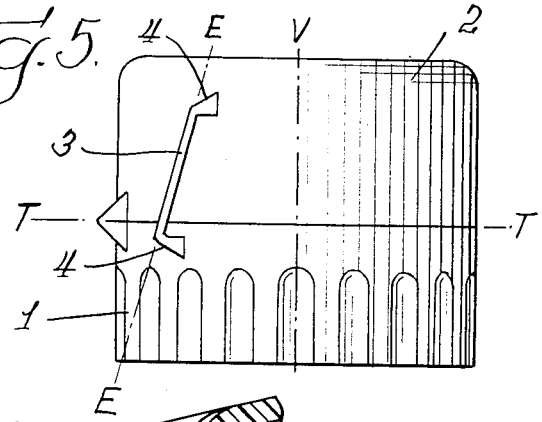
Figure 7:
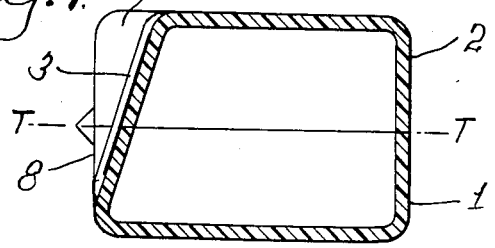
Figure 7A:
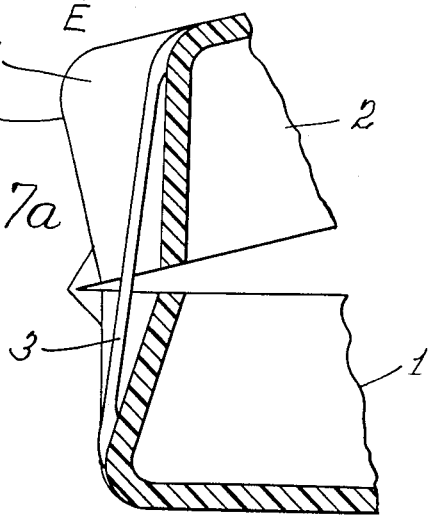

FIG. 3 represents a like closure for superimposition on a container with prismatic form and FIG. 4 again shows the closure according to FIG. 3 in side view FIG. 5 clarifies the inclined position of tensioning bands on a cylindrical closure FIG. 6 is a plan view of a container formed with a closure according to the invention, and FIG. 7 shows the section through the container according to FIG. 6 along the line A—A, while FIG. 7*a* shows a detail cut-out of FIG. 7

In FIGS. 8*a–d* there are represented four opening positions of a hingeless closure.

The closure according to the invention consists always of a lower part 1 and a cap or cover 2. According to the use of the closure the lower part 1 is superimposed on a firm or deformable container (not shown in the drawing) or is itself the lower part of the container.

In FIGS. 1–5 and 8*a* to *d* there are shown closures for superimposition on firm or deformable containers. In the closed state of the closure the lower part 1 and the cap 2 lie in direct contact one upon another. The contact surface lies in the so-called separating plane, which is designated with T in the drawing. The lower part 1 and the cap or cover 2 are integrally joined with one another over at least one tensioning band 3. By way of lugs 4 the tensioning bands 3 are slightly spaced from the lower part 1 and from the cap 2. The tensioning bands 3 run in a plane E. The plane E cuts the closure and is parallel to its central axis a. In the variant according to FIGS. 1 and 2 the lower part 1 and the cap 2 are joined with one another over a film hinge 5.

The pivot axis of the film hinge 5 lies, on the one hand, in the separating plane T and, on the other hand, parallel to the plane E in which the tensioning bands 3 lie.

In the closed position of the closure the tensioning bands 3 are tensioned, whereby there is present a resulting force which lies within the limits of the closure and maintains a closing pressure between lower part 1 and cap 2. If the closure is meant for use on a container with gaseous content, then the closing pressure should be as great as possible.

This can be adjusted correspondingly by the dimensioning and positioning of the tensioning bands. In this connection there must not be neglected material-conditioned, physical properties such as modulus of elasticity and strength. An optimum solution often can be found only empirically. The variable magnitudes and their dimensioning are the width and the thickness of the tensioning bands 3, as well as the spacing in the plane E in which the tensioning bands 3 lie to the axis of rotation a of the closure.

While many possible locking members can be combined with the closure according to the invention none is illustrated.

Obviously the closure of the invention can be combined with every type of known locking members, for example also with a child-safe locking member.

The closure according to the invention can, with suitable adaptation, be made with any form or shape of lower part and cap. FIGS. 3 and 4 show a lower part 1 and an equal-coverage cap 2 with dodecagonal shape.

The tensioning bands 3, which are fastened over lugs 4 to the cap 2 and to the lower part 1, lie again in a plane E that cuts the closure. The hinge 5 is located in the side surface 6 and lies parallel to the plane E.

In FIGS. 1–4 the plane E in which the tensioning bands 3 lie runs parallel to a vertical to the separating plane T, which in the present case is identical to the central axis a. This, however, is by no means compulsory, as the embodiment according to FIG. 5 shows. Here, too, the tensioning bands 3 run in a plane E which again cuts the closure, but the plane E this time is inclined to the vertical v to the separating plane T. In the example represented according to FIG. 5 also the lugs 4, in contrast to the examples previously described, are arranged asymmetrically to the separating plane T. The obliquely running tensioning bands 3 bring about two effects. In the first place, the resulting contact pressure force between lower part 1 and cap 2 increases toward the center of the closure, and, in the second place, this arrangement influences an easy change of the closing movement, whereby a centering pin may be arranged in the cap to obtain a more exact introduction into an outlet to be sealed by the centering pin.

This is especially advantageous if the closure is made hingeless, as is described still with the aid of FIGS. 8*a*–8*d*.

Through the asymmetrical arrangements of the outlets 4 on the lower part 1 and on the cap 2, the position of the maximal stretch of the tensioning bands 3 can be correspondingly shifted. From the position of maximal stretch coincident with the plane E the cap folds over in the direction of closing or opening position. The desired opening position of cap 2, in which the tensioning bands 3 are relaxed may be desired otherwise according to the nature of the closure, the form of the outlet or the type of container to be closed.

In FIG. 6 there is represented a container that is designed with the closure according to the invention. The container, and also the lower part 1 and the cap 2 present a roughly rectangular shape. Lower part 1 and cap 2 are joined with one another over three tensioning bands arranged in the same side surface. Instead of the three tensioning bands here represented, the closure can obviously be formed also of a single, but somewhat broader tensioning band. Here, too, again the tensioning bands 3 are arranged inclined to a vertical v to the separating plane T. For this, the tensioning bands 3 lie in niche-type recesses 7, which are inclined to the lengthwise side 8 of the container.

In FIG. 7 there is shown a section along the line A—A according to FIG. 6. From FIG. 7*a* there are clarified in detail the relations in the zone of the niche-type recess 7. The arrangement of the tensioning bands 3 in niche-type recesses can be released, of course, also in other closure forms than that of the figures described above. The arrangement of the tensioning bands 3 in niche-type recesses 7 has the advantage that no parts of the closure project beyond the contour of the lower part or of the cap, respectively. This is especially advantageous when the closure is emplaced on a container by machinery, for it is not necessary then for the closure any longer to be aligned on a gripper corresponding to the protruding parts.

In FIGS. 8*a*–*d* there is represented a hingeless closure in various stages of opening. Again there is illustrated a closure with cylindrical lower part 1 and covering cap 2. The lugs 4, for the tensioning bands 3 again lie asymetrically to the separating plane T. Obviously, here too, the plane E in which the tensioning bands 3 lie, cuts the closure.

The special matter in the present closure lies in that it presents no hinge, so that cap 2 and lower part 1 are joined with one another exclusively over the tensioning bands 3. In the closed position according to FIG. 8*a*, the closing forces that are exerted by the tensioning bands 3 behave in the same way as in the embodiments previously described. The closing force lies within the plane E and is represented by an arrow F1.

Figure 8A:
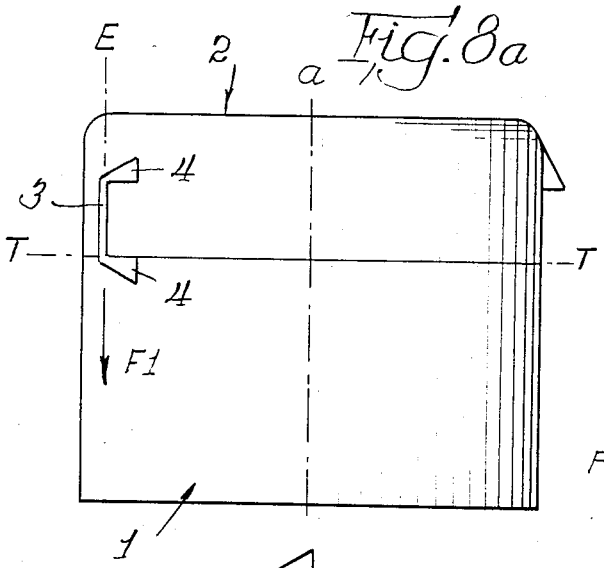
Figure 8B:
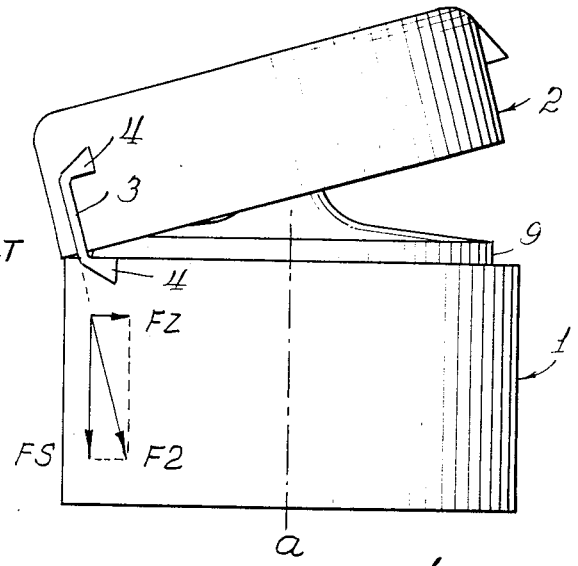

FIG. 8*b* shows the same closure in a slightly open intermediate position. The tensioning bands 3 are now stretched somewhat more strongly and now bring about a somewhat increased resulting force F2. The resulting F2 runs, now as before, in the plane of the tensioning bands, which is now inclined in correspondence to the degree of opening of the cap 2. Consequently, the resultant force F2 can be resolved into a component FS, which tends to close the cap 2 and into a component FZ, which is inclined to draw the cap 2 to the center, toward the central axis a. In this position the lower part 1 is also shown to have a structure 9 which is displaced inward about by the wall thickness of the cap 2, concentrically to the central axis a. The structure 9 extends conically to a center outlet opening 10.

In the position according to FIG. 8*b*, the central axis is parallel to the plane E and runs exactly through the contact point of cap 2 and lower part 1.

Figure 8C:
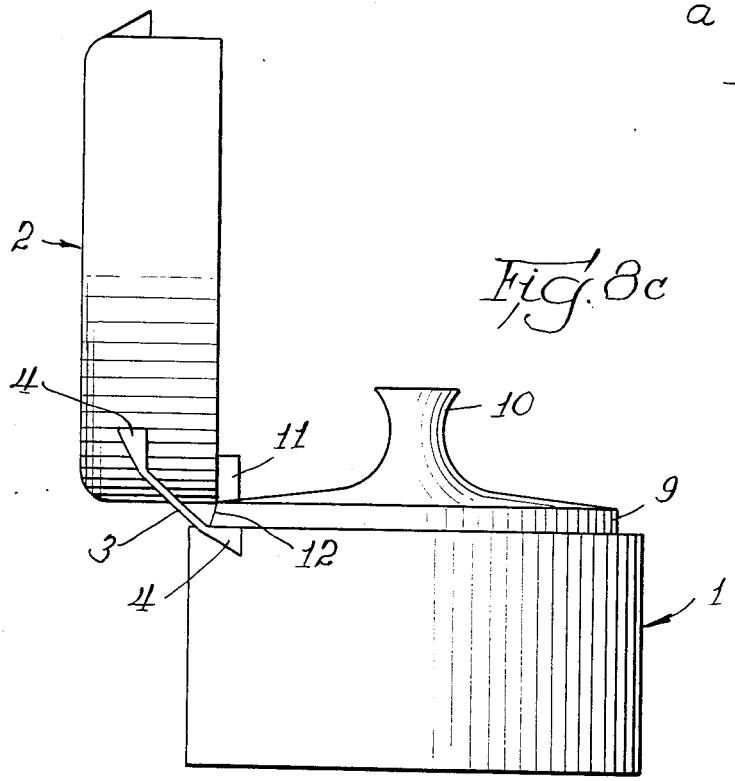

As the opening angle of the cap 2 increases, the component FS decreases and the component FZ correspondingly increases. This happens until the force vector FZ overcomes the friction between lower part 1 and cap 2, whereupon the cap 2 abruptly strikes against the set-back structure 9. There, the cap 2 is completely opened, as represented in FIG. 8*c*, and the tensioning bands 3 are largely relaxed, but not completely, so that there remains a slight resulting force, which holds the cap 2 in the open position according to FIG. 8*c*. If the structure 9 presents only a slight structure height, as represented in FIG. 8*c*, then the tensioning bands 3 could draw the cap 2 onto the structure 9 and thereby make considerably more difficult a reclosing of the cap 2. For this case a stop 11 is molded on the structure 9, which is present in the zone between the two lugs 4 of the lower part 1. The course of movement in the opening, and especially in the closing of the closure may be facilitated by rounding the transition 12 from the lower part 1 to the structure 9. If the structure 9 is relatively low as represented in FIG. 8*c*, then the rounded transition 12 can run directly from the separating plane T to the stop 11.

Figure 8D:
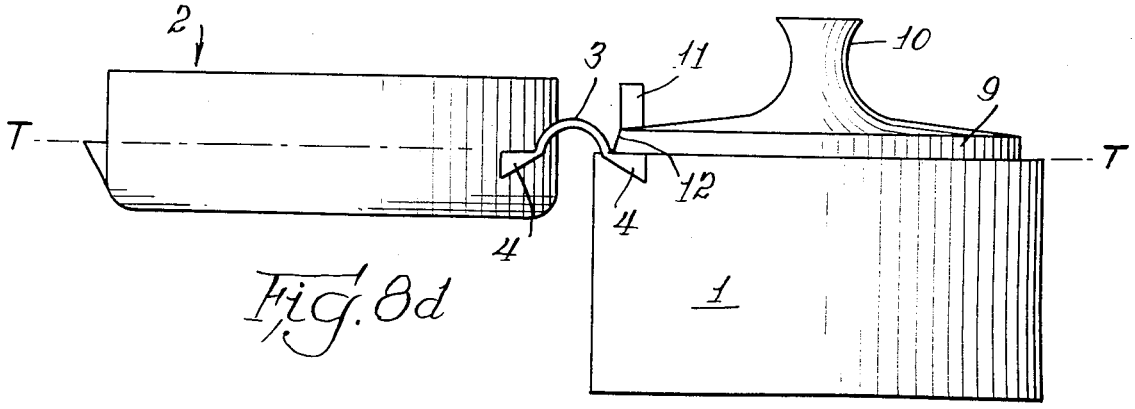

In FIG. 8*d*, the closure according to the invention is finally represented in the spraying position. The separating plane T is here the same as the separating plane of the injection mold for the closure. The tensioning bands 3 are molded in arcuate form, so that they present a greater length than the distance between the two corresponding lugs 4 when in the injection mold.

The hingeless form is possible, of course, not only in the case of rounded closures, but theoretically in every form of the closure. In the embodiment according to FIGS. 6 and 7 it would be necessary merely to speak instead of about a contact point, about a contact line. If the closure of FIG. 6 has an odd number of tensioning bands, then it would be necessary, in the event that the structure 9 has too low a structural height, to provide an even number of stops 11. In a container the structure 9 would would have corresponding to it, for example, only an inset border, such as is known from many boxes.

What is claimed is:

1. A molded synthetic material snap-closure for containers, including a lower part shaped to be fixed to a container and a cover swingably joined to said lower part, said lower part having a central axis, the swingable junction of said snap-closure being such that said cover and said lower part contact one another at a first side of said snap-closure during opening and closing thereof, and in which said cover in the closed position of the closure completely covers said lower part, whereby a contacting area between said lower part and said cover forms a separating plane (T) with said axis passing through said separating plane, and including at least one tensioning band integrally connected by lugs (4) to both said cover (2) and to said lower part (1), said lugs being arranged such that, in the closed state of the snap closure, said tensioning band is stretched along a straight line and lies in a plane (E) spaced from said axis, said plane (E) intersecting the separating plane (T) at a location spaced from said axis, said location being adjacent the first side of said snap-closure and said snap-closure being formed of one piece of said synthetic material.

2. Synthetic material closure according to claim 1, in which the plane (E) runs perpendicular to the separating plane (T) between the lower part (1) and cover (2).

3. Synthetic material closure according to claim 1, in which the plane (E) runs inclined to the separating plane (T) between lower part (1) and cover (2).

4. Synthetic material closure according to claim 1, in which the lower part (1) with the cover (2) are additionally joined with one another by a hinge (5), the axis of which forms at least approximately a tangent to the closure.

5. Synthetic material closure according to claim 1, in which the lower part (1) and cover (2) are connected to one another hingelessly by the tensioning band (3).

6. Synthetic material closure according to claim 5, in which the lower part (1) of the closure includes a structure (9) raised with respect to the separating plane (T) between cap (2) and lower part (1), which structure (9) is displaced inwardly approximately the wall thickness of the cover (2).

7. Synthetic material closure according to claim 6, in which the cover (2) is swingable about a contact point on the lower part (1), the contact point moving during the opening and closing process upon the structure (9).

8. Synthetic material closure according to claim 6, in which the raised structure (9) includes in the zone between two said tensioning bands (3) a rounded transition (12) from the separating plane (T) to the structure (9).

9. Synthetic material closure according to claim 5, in which on the lower part (1) of the closure, in the zone between two said tensioning bands (3) there is arranged a stop (11) rising over the separating plane (T) between cover and lower part.

10. Synthetic material closure according to claim 1 including a polygonal circumference of said closure, and in which the tensioning band (3) lies in a plane (E) which runs parallel to an adjacent edge (6) of the polygonal circumference of the closure.

* * * * *